US006448721B2

(12) United States Patent
Raitses et al.

(10) Patent No.: US 6,448,721 B2
(45) Date of Patent: Sep. 10, 2002

(54) CYLINDRICAL GEOMETRY HALL THRUSTER

(75) Inventors: Yevgeny Raitses; Nathaniel J. Fisch, both of Princeton, NJ (US)

(73) Assignee: General Plasma Technologies LLC, Princeton, NJ (US)

( * ) Notice: Subject to any disclaimer, the term of this patent is extended or adjusted under 35 U.S.C. 154(b) by 0 days.

(21) Appl. No.: 09/834,397

(22) Filed: Apr. 13, 2001

Related U.S. Application Data

(60) Provisional application No. 60/197,282, filed on Apr. 14, 2000.

(51) Int. Cl.[7] ..... H05H 7/00; H01J 1/50

(52) U.S. Cl. ..... 315/501; 313/161

(58) Field of Search ..... 315/94, 95, 96, 315/98, 99, 100, 500, 501, 507; 313/161, 325, 356

(56) References Cited

U.S. PATENT DOCUMENTS 5,274,306 A * 12/1993 Kaufman et al. ..... 315/111.41
5,751,113 A * 5/1998 Yashnov et al. ..... 315/111.21
6,075,321 A * 6/2000 Hruby ..... 315/111.91
6,281,622 B1 * 8/2001 Valentian et al. ..... 313/362

* cited by examiner

*Primary Examiner*—Don Wong
*Assistant Examiner*—D A Minh

(57) ABSTRACT

An apparatus and method for thrusting plasma, utilizing a Hall thruster with a cylindrical geometry, wherein ions are accelerated in substantially the axial direction. The apparatus is suitable for operation at low power. It employs small size thruster components, including a ceramic channel, with the center pole piece of the conventional annular design thruster eliminated or greatly reduced. Efficient operation is accomplished through magnetic fields with a substantial radial component. The propellant gas is ionized at an optimal location in the thruster. A further improvement is accomplished by segmented electrodes, which produce localized voltage drops within the thruster at optimally prescribed locations. The apparatus differs from a conventional Hall thruster, which has an annular geometry, not well suited to scaling to small size, because the small size for an annular design has a great deal of surface area relative to the volume.

20 Claims, 6 Drawing Sheets

CYLINDRICAL GEOMETRY HALL THRUSTER

CROSS REFERENCE TO RELATED APPLICATIONS

This application claims priority from U.S. Provisional Application Ser. No. 60/197,282 filed Apr. 14, 2000, by applicants Yevgeny Raitses and Nathaniel J. Fisch, the disclosure of which is incorporated herein by reference.

CONTRACTUAL ORIGIN OF THE INVENTION AND STATEMENT AS TO FEDERALLY SPONSORED RESEARCH

Pursuant to 35 U. S. C. 202(c), it is acknowledged that the U. S. Government has certain rights in the invention described herein which was made in part with funds from the Department of Energy under Grant No. DE-AC02-76-CHO-3073 under contract between the U.S. Department of Energy and Princeton University. Princeton University has served notice that it does not wish to retain title to this invention.

BACKGROUND OF THE INVENTION

The present invention pertains generally to electric plasma thrusters and more particularly to Hall field thrusters, which are sometimes called Hall accelerators.

The Hall plasma accelerator is an electrical discharge device in which a plasma jet is accelerated by a combined operation of axial electric and magnetic fields applied in a coaxial channel. The conventional Hall thruster overcomes the current limitation inherent in ion diodes by using neutralized plasma, while at the same time employing radial magnetic fields strong enough to inhibit the electron flow, but not the ion flow. Thus, the space charge limitation is overcome, but the electron current does draw power. Hall thrusters are about 50% efficient. Hall accelerators do provide high jet velocities, in the range of 10 km/s to 20 km/s, with larger current densities, about 0.1 A/cm$^2$, than can conventional ion sources.

Hall plasma thrusters for satellite station keeping were developed, studied and evaluated extensively for xenon gas propellant and jet velocities in the range of about 15 km/s, which requires a discharge voltage of about 300 V. Hall thrusters have been developed for input power levels in the general range of 0.5 kW to 10 kW. While all Hall thrusters retain the same basic design, the specific details of an optimized design of Hall accelerators vary with the nominal operating parameters, such as the working gas, the gas flow rate and the discharge voltage. The design parameters subject to variation include the channel geometry, the material, and the magnetic field distribution.

A. V. Zharinov and Yu. S. Popov, "Acceleration of plasma by a closed Hall current", *Sov. Phys. Tech. Phys.* 12, 1967, pp. 208–211 describe ideas on ion acceleration in crossed electric and magnetic field, which date back to the 1950's. The first publications on Hall thrusters appeared in the United States in the 1960's, such as: G. R. Seikel and F. Reshotko, "Hall Current Ion Accelerator", *Bulletin of the American Physical Society, II* (7) (1962) and C. O. Brown and E. A. Pinsley, "Further Experimental Investigations of Cesium Hall-Current Accelerator", *AIAA Journal,* V.3, No 5, pp. 853–859, 1965.

Over the last thirty years, A. I. Morozov designed a series of high-efficiency Hall thrusters. See, for example, A. I. Morozov et al., "Effect of the Magnetic field on a Closed-Electron-Drift Accelerator", *Sov. Phys. Tech. Phys.* 17(3), pp. 482–487 (1972), A. I. Morosov, "Physical Principles of Cosmic Jet Propulsion", *Atomizdat,* Vol. 1, Moscow 1978, pp. 13–15, and A. I. Morozov and S. V. Lebedev, "Plasma Optics", in *Reviews of Plasma Physics,* Ed. by M. A. Leontovich, V.8, New York-London (1980).

H. R. Kaufman, "Technology of Closed Drift Thrusters", *AIAA Journal* Vol. 23 p. 71 (1983), reviews of the technology of Hall field thrusters, both in the context of other closed electron drift thrusters and in the context of other means of thrusting plasma. V. V. Zhurin et al., "Physics of Closed Drift Thrusters", *Plasma Sources Science Technology* Vol. 8, p. R1 (1999), further reviews the physics and more recent developments in the technology of Hall thrusters.

What remains a challenge is to develop a Hall thruster able to operate efficiently at low power. To reduce the cost of various space missions, there is a strong trend towards miniaturization of satellites and their components. For some of these missions, which use on board propulsion for spacecraft orbit control, this miniaturization requires development of micro electric thrusters, having a large specific impulse (1000–2000 sec), which can operate efficiently at low input power levels, that is, less than 200 watts. However, existing small Hall thrusters, which are simply scaled down by means of a linear scaling to operate at low input power, are very significantly less efficient than Hall thrusters operating at input power larger than 0.5 kW.

The conventional annular design is not well suited to scaling to small size, because the small size for an annular design has a great deal of surface area relative to the volume. A more sensible design at small size would be a cylindrical geometry design. A cylindrical design may also be useful at high power, but it may be technologically indispensable for Hall field acceleration at low power.

The present invention comprises an improvement over the prior art cited above by providing for efficient operation of a cylindrical geometry Hall thruster, in which the center pole piece of the conventional annular design thruster is eliminated or greatly reduced. The present invention discloses means of accomplishing efficient operation of such a thruster by designing magnetic fields with a substantial radial component, such that ions are accelerated in substantially the axial direction.

The present invention comprises an improvement as well as over the following prior art:

U.S. Pat. No. 4,862,032 ("End-Hall ion source", Kaufman et al., Aug. 29, 1989) discloses specifically that the magnetic field strength decreases in the direction from the anode to the cathode. The disclosure of the above referenced patent is hereby incorporated by reference.

Other design suggestions are disclosed in U.S. Pat. No. 5,218,271 ("Plasma accelerator with closed electron drift", V. V. Egorov et al., Jun. 8, 1993) which contemplates a curved outlet passage. The disclosure of the above referenced patent is hereby incorporated by reference. U.S. Pat. No. 5,359,258 ("Plasma accelerator with closed electron drift", Arkhipov et al., Oct. 25, 1994) contemplates improvements in magnetic source design by adding internal and external magnetic screens made of magnetic permeable material between the discharge chamber and the internal and external sources of magnetic field. The disclosure of the above referenced patent is hereby incorporated by reference.

U.S. Pat. No. 5,475,354 ("Plasma accelerator of short length with closed electron drift", Valentian et al., Dec. 12, 1995) contemplates a multiplicity of magnetic sources producing a region of concave magnetic field near the acceleration zone in order better to focus the ions. The disclosure of the above referenced patent is hereby incorporated by reference. U.S. Pat. No. 5,581,155 ("Plasma accelerator with closed electron drift", Morozov, et al., Dec. 3, 1996) similarly contemplates specific design optimizations of the conventional Hall thruster design, through specific design of the magnetic field and through the introduction of a buffer chamber. The disclosure of the above referenced patent is hereby incorporated by reference.

U.S. Pat. No. 5,763,989 ("Closed drift ion source with improved magnetic field", H. R. Kaufman Jun. 9, 1998) contemplates the use of a magnetically permeable insert in the closed drift region together with an effectively single source of magnetic field to facilitate the generation of a well-defined and localized magnetic field, while, at the same time, permitting the placement of that magnetic field source at a location well removed from the hot discharge region. The disclosure of the above referenced patent is hereby incorporated by reference.

U.S. Pat. No. 5,847,493 ("Hall effect plasma accelerator", Yashnov et al., Dec. 8, 1998) proposes that the magnetic poles in an otherwise conventional Hall thruster be defined on bodies of material which are magnetically separate. The disclosure of the above referenced patent is hereby incorporated by reference.

U.S. Pat. No. 5,845,880 ("Hall effect plasma thruster", Petrosov et al., Dec. 8, 1998) proposes a channel preferably flared outwardly at its open end so as to avoid erosion. The disclosure of the above referenced patent is hereby incorporated by reference.

BRIEF SUMMARY OF THE INVENTION

It is an object of this invention to provide a cylindrical Hall plasma thruster, made efficient by means of detailed control of the magnetic and electric fields.

The cylindrical configuration consists of a cylindrical ceramic channel, in which there is imposed a magnetic field strong enough to impede the motion of the electrons but not the motion of the ions. The imposed magnetic field is substantially axial near the gas entrance and substantially radial near the gas exit. The invention exploits the fact that, as in a conventional Hall thruster, the lines of magnetic force substantially form equipotential surfaces, so that where the magnetic field is radial, the electric field is axial and where the magnetic field is axial the electric field is radial. Electrons are therefore impeded axially, and tend to drift in the azimuthal direction about the cylinder axis, whereas ions are accelerated radially where the magnetic field is substantially axial and axially where the magnetic field is substantially radial.

The invention utilizes appropriate magnetic circuits to enlarge the region in which the magnetic field is largely radial, and therefore the acceleration of the ions is largely axial. The invention discloses means for the gas to be preferentially ionized near those regions, so that substantial axial acceleration of ions results.

SUMMARY OF INVENTION

The present invention is a new kind of Hall thruster, which has a cylindrical ceramic channel and at least two magnetic poles. One magnetic pole is located on the thruster axis on the back wall of the channel, or slightly in front of the back wall of the channel. The other pole is located at the open exit of the channel. This design may be understood with reference to FIG. 1. As shown in FIG. 1, such a magnetic circuit produces a magnetic field that is substantially axial near the gas inlet, and is substantially radial after a region of ionization. In the vicinity of the radial magnetic field, ions undergo substantially axial acceleration as they do in a conventional Hall thruster geometry, with an annular channel design.

We disclose herein methods of producing an electric potential profile, an ionization profile, and a magnetic field profile such that ions tend to be accelerated axially.

In the simplest embodiment of the present invention, the electric potential profile is established without detailed control between the anode 7 and hollow cathode 8. Gas is input in the vicinity of the anode and then ionized through impact with energetic electrons. There will be substantial acceleration of the ions in the axial direction because the magnetic field lines support a potential drop in the axial direction. The axial acceleration occurs where the magnetic field is radial. Therefore the magnetic field is arranged to have a substantial radial component.

In order to enhance the acceleration of the ions in the axial direction, we disclose that the ionization region can be arranged to occur substantially near where the magnetic field lines are radial, rather than where the magnetic field lines are axial. To do so, the gas may be introduced into the channel away from the channel mid-plane. Thus, the anode 7, which can also be a gas distributor, can have an annular geometry.

In order to further control the axial acceleration of the ions, segmented electrodes 26 can be introduced along the channel walls (see FIG. 2). Since each magnetic field line is substantially at the same electric potential, because electrons can freely more along the field line, the introduction of segmented electrodes in the ceramic channel wall can define a potential drop between any two magnetic field lines. We disclose an efficient means of axially accelerating said ions occurs by thus arranging the main potential drop in the region where the radial magnetic field is closest to the ionization region.

As a further enhancement of the axial acceleration of the ions, we disclose that the magnetic field can be made more nearly radial through the introduction of a second magnetic coil 6 (see FIG. 3). The second coil also provides for focusing of the ion stream.

In a preferred embodiment of the invention, the magnetic pole 10 can protrude somewhat in front of the anode (see FIG. 4). This produces a very small annular region in front of the gas distributor. In this annular region the magnetic field is almost purely radial. This annular region then serves as an enhanced ionization region. To further enhance the axial acceleration, segmented electrodes can be used as well in this configuration (see FIG. 5).

In a preferred embodiment, the front of the magnetic pole 10 can serve as an excellent location for a cathode-neutralizer. In FIG. 6, we disclose the use of a segmented emissive electrode 18 placed in the ceramic channel 12 in front of the magnetic pole piece 10. This emissive electrode 18 can provide electrons in a region where they will not be impeded by the magnetic field as they escape from the thruster. Therefore, this emissive electrode can provide electrons to neutralize the accelerated ions. In yet a further preferred embodiment, segmented emissive electrode 18 can replace entirely the cathode neutralizer 8.

DETAILED DESCRIPTION OF THE INVENTION

The invention results from the realization that a cylindrical geometry Hall thruster is possible, so long as the magnetic field is made with a substantial radial component, the ions are introduced to the magnetic field largely in the region where the magnetic field is radial, and the axial potential drop largely occurs over said same region where the ions are largely introduced. The method of acceleration is then substantially the same as in a conventional Hall thruster which employs substantially only radial fields. However, the geometry introduced here has substantial technological advantages, particularly at low power and at small sizes.

In order to control each of these components of the scheme, methods are employed to produce the appropriate fields and ionization profiles.

Figure 1:
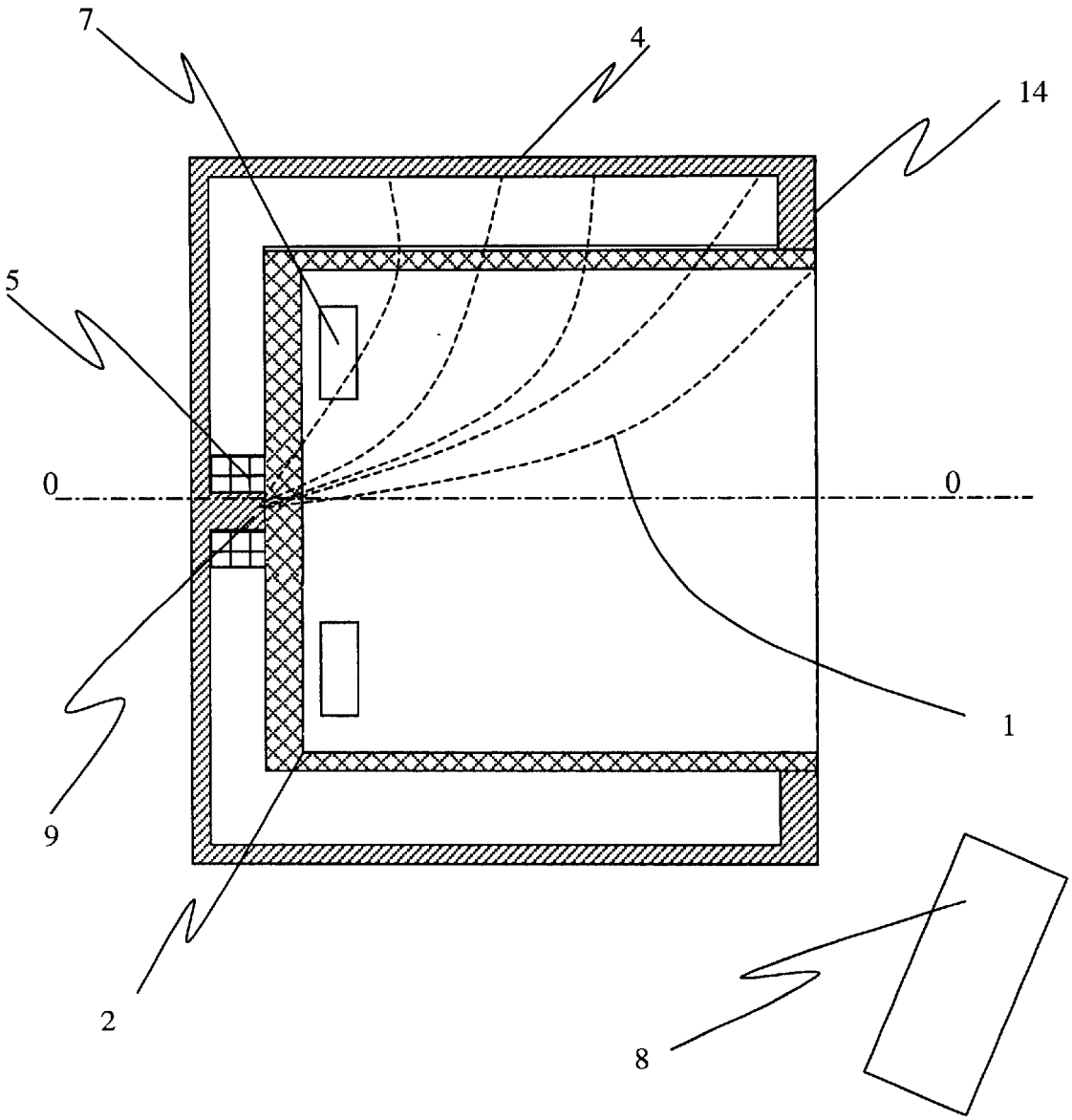
FIG. 1 is a schematic representation of a cylindrical geometry Hall thruster with a cylindrical ceramic channel 2. Line 0—0 is an axis of symmetry. Magnetic field lines 1 extend from magnetic pole 9 to magnetic pole 14. Magnetic coils 5 generate said magnetic field, which is guided along magnetic circuit 4. A voltage is applied between anode 7 and cathode 8. Anode 7 can also be a gas distributor.
Figure 2:
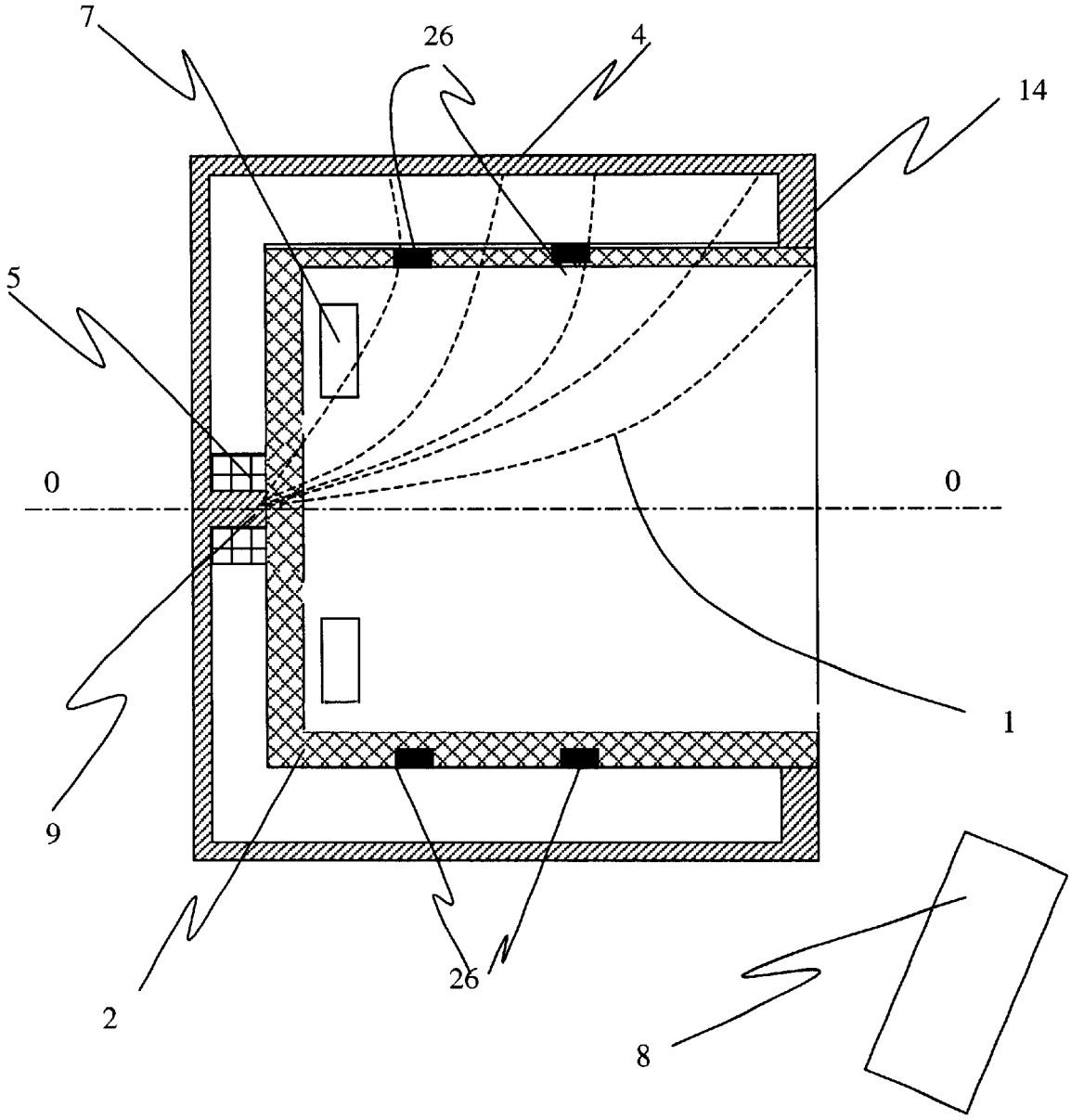
FIG. 2 is a schematic representation of a cylindrical geometry Hall thruster with segmented electrodes 26.
Figure 3:
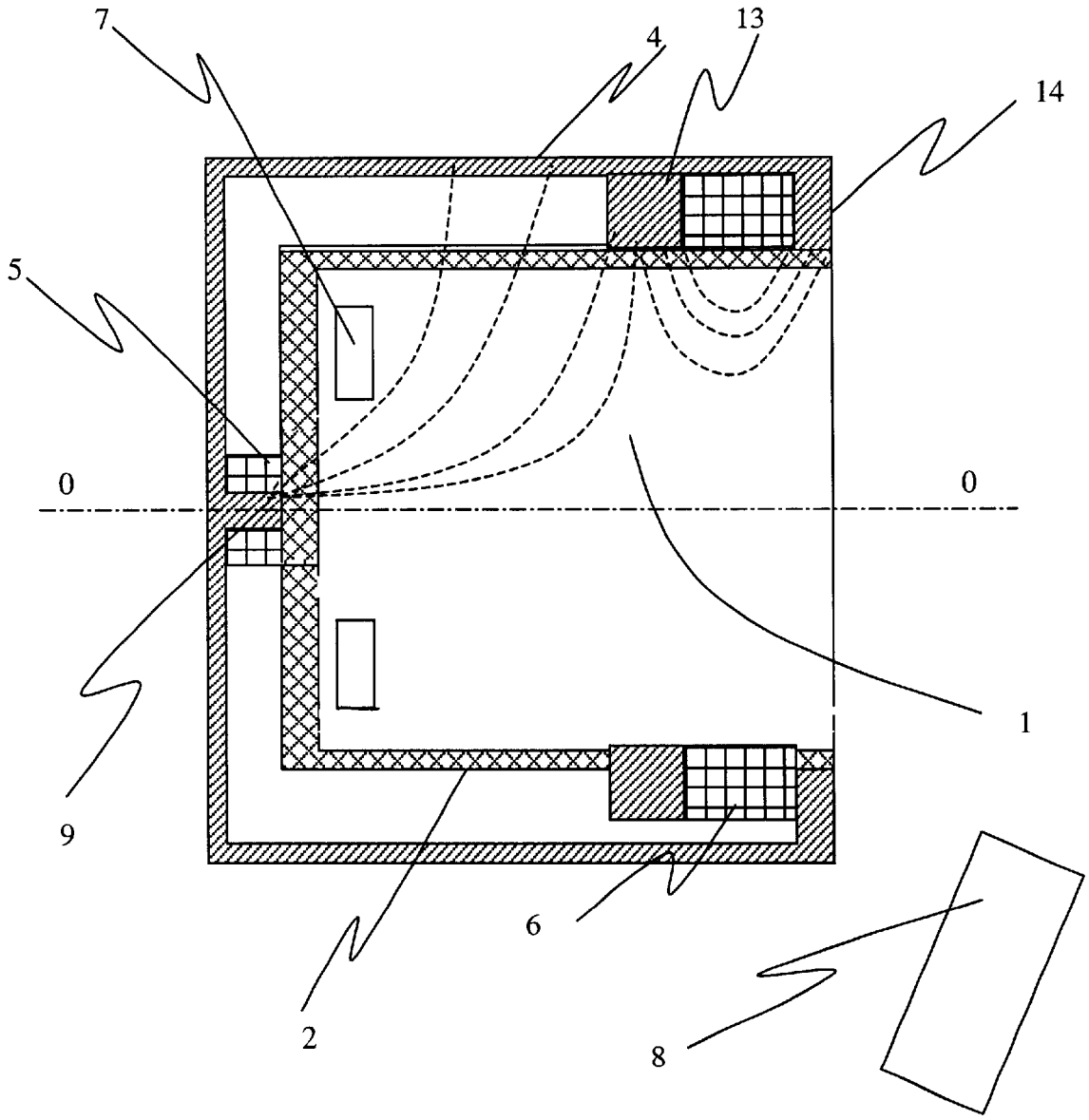
FIG. 3 is a schematic representation of a cylindrical geometry Hall thruster with second coil set to give a more radial magnetic field. The magnetic lines of force 1 extend from magnetic pole 9 to outer magnetic poles 13 and 14. In the vicinity of magnetic pole 13, the magnetic field has cusp geometry.
Figure 4:
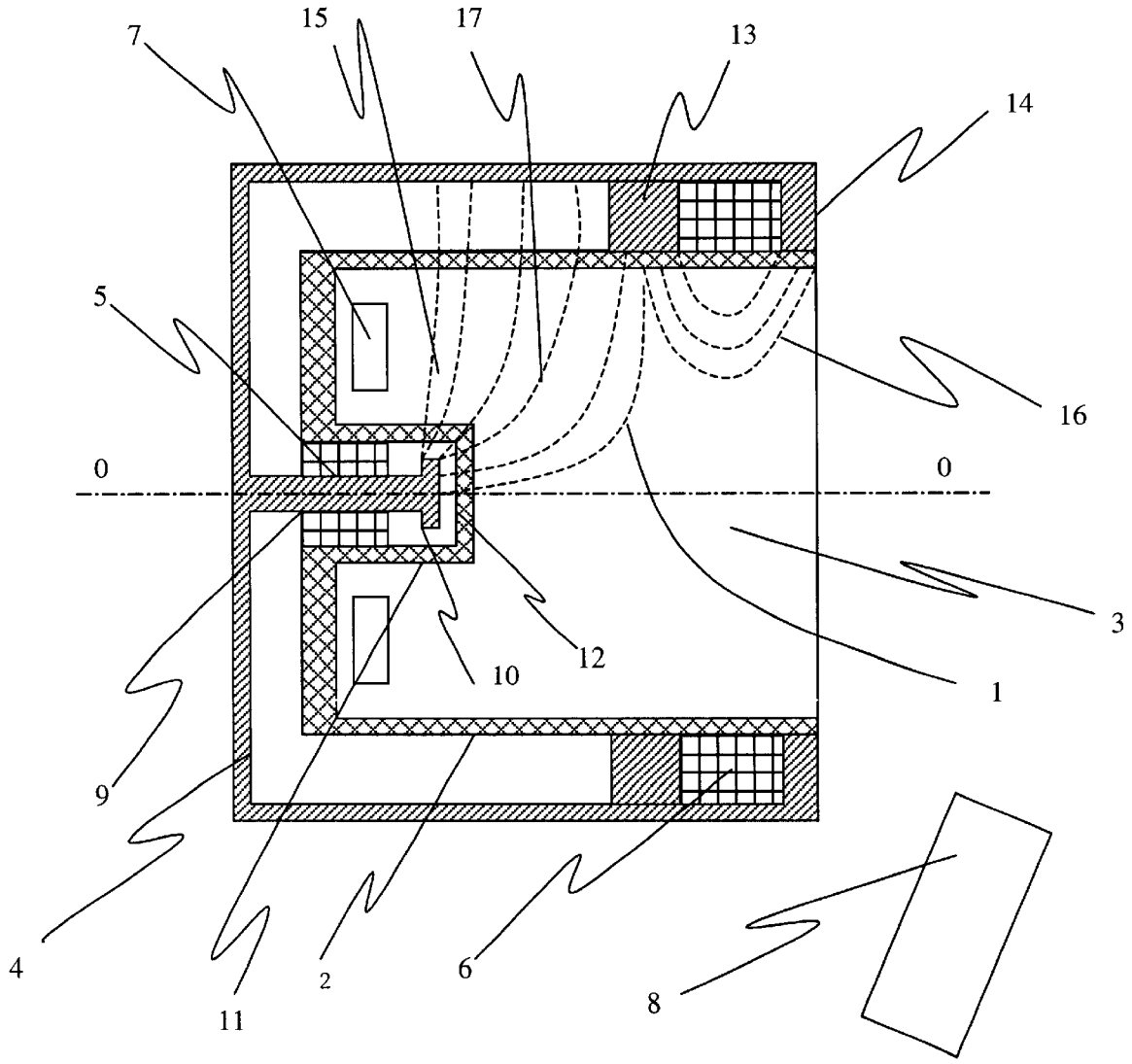
FIG. 4 is a schematic representation of a cylindrical geometry Hall thruster with a cylindrical channel region 3 and a shorter annular channel region 15, magnetic circuit 4, electromagnetic coil 5, electromagnetic coil 6, anode 7, which can be also a gas distributor, and cathode 8. The magnetic lines of force 1 extend from magnetic pole 10 to outer magnetic poles 13 and 14. In the vicinity of magnetic pole 13, the magnetic field has cusp geometry.
Figure 5:
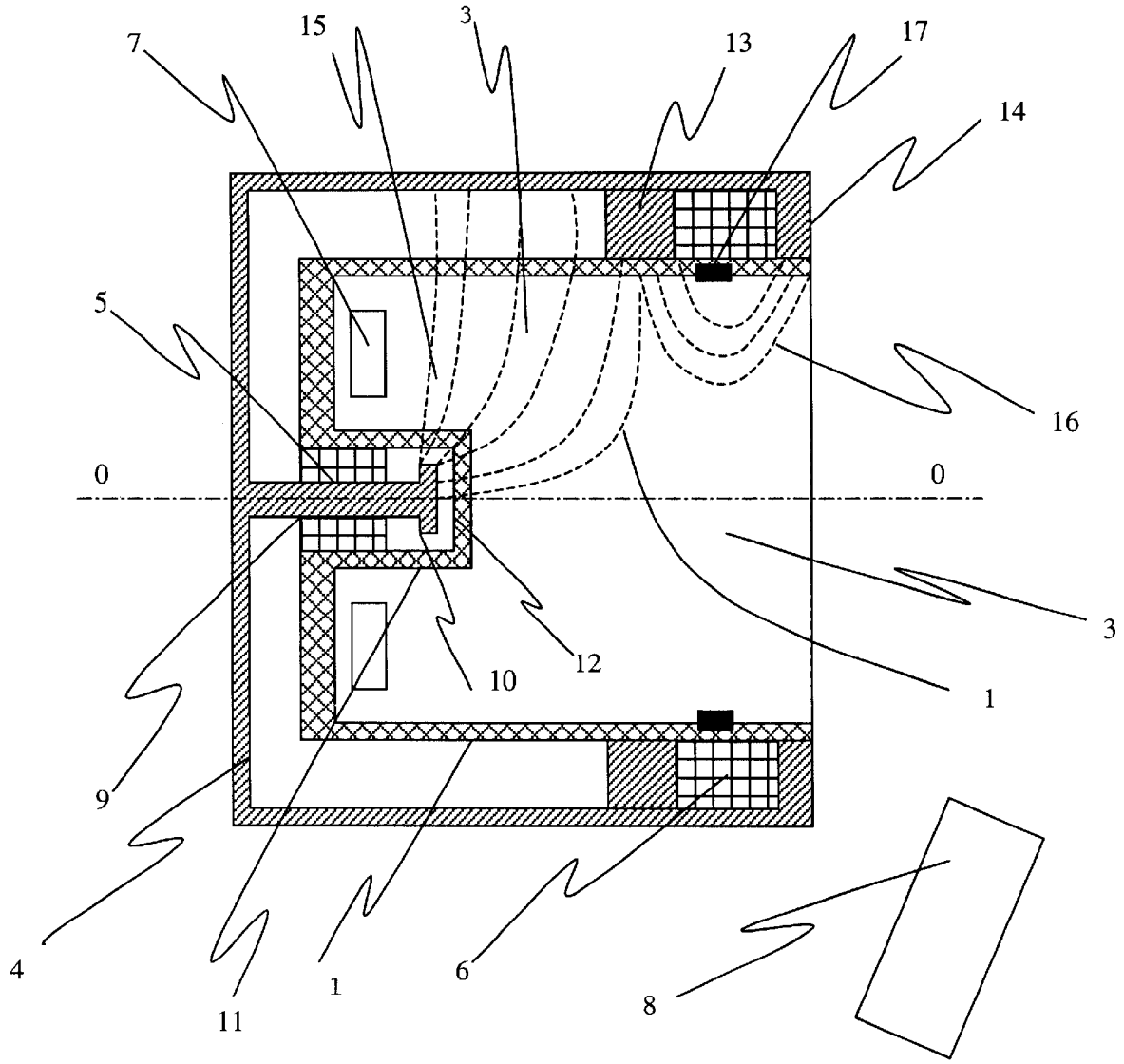
FIG. 5 is a schematic representation of a cylindrical geometry Hall thruster as in FIG. 4, with a cylindrical channel region 3 and a shorter annular channel region 15, with segmented electrode ring 17 defining the potential between outer magnetic pole pieces 13 and 14.

To produce magnetic fields with a large radial component, magnetic poles can be deployed as in FIG. 1. In a preferred embodiment, additional coils are introduced as in FIG. 3, in order to produce a magnetic cusp. In the vicinity of the cusp, the magnetic field tends to be largely radial. Details of the magnetic field can be adjusted by adjusting the coil currents, including the relative coil currents of the two magnetic coils. To produce the cusp geometry, the second coil is energized such that the magnetic field generated 16 is in the same radial direction as the applied magnetic field in the vicinity of magnetic pole 13, while the axial component of the magnetic field of the second coil 16 cancels the applied axial magnetic field of the first coil in the thruster interior. Alternatively, permanent magnets accomplishing the same magnetic geometry can be used.

In order to control the electric field profile, segmented electrodes can be introduced. The segmented electrodes can be connected to a bias power supply. Said bias power supply can be the main discharge power supply, a separate power supply, or a power supply though a separate electric circuit from the main discharge power supply with a different potential applied such as via a resistor. In the case of several segmented electrodes, each ring can be biased separately at different potentials, from the same or separate power supplies or separate electric circuits.

The electrodes can either be non-emissive or emissive. Non-emissive segmented electrodes can be made from a low sputtering material such as graphite or graphite modifications such as carbon-carbon fibers, tungsten, or molybdenum. Emissive segmented electrodes can be made from high-temperature low sputtering and low work function materials. Said materials include LaB6, dispenser tungsten, and barium oxide. To provide higher emissivity, additional external heating can be supplied from a heating filament inserted into the electrode structure. Details of the use of such electrodes can be found in the literature (Raitses et al., "Plume Reduction in Segmented Electrode Thruster," *Journal of Applied Physics* 88, 1263, August 2000; Fisch et al., "Variable Operation of Hall Thruster with Multiple Segmented Electrodes", *Journal of Applied Physics* 89, 2040).

In order to control the ionization region, the gas may be introduced off the central axis.

Note that the present invention differs substantially from all Hall type thrusters. The closest configuration in the literature appears to be U.S. Pat. No. 4,862,032 ("End-Hall ion source", Kaufman et al., Aug. 29, 1989). However, in addition to other differences, the source disclosed by Kaufman et al. has a very strong axial field with no attempt to have a strong radial field, something that is necessary for axial acceleration. Also, the channel contemplated by Kaufman et al. is made from metal rather than ceramic. That means that equipotential surfaces cannot be defined on the channel wall as we disclose here. Moreover, metals tend to have low secondary electron emission, which makes the electron temperature very high, which will introduce significant electric sheath effects.

Figure 6:
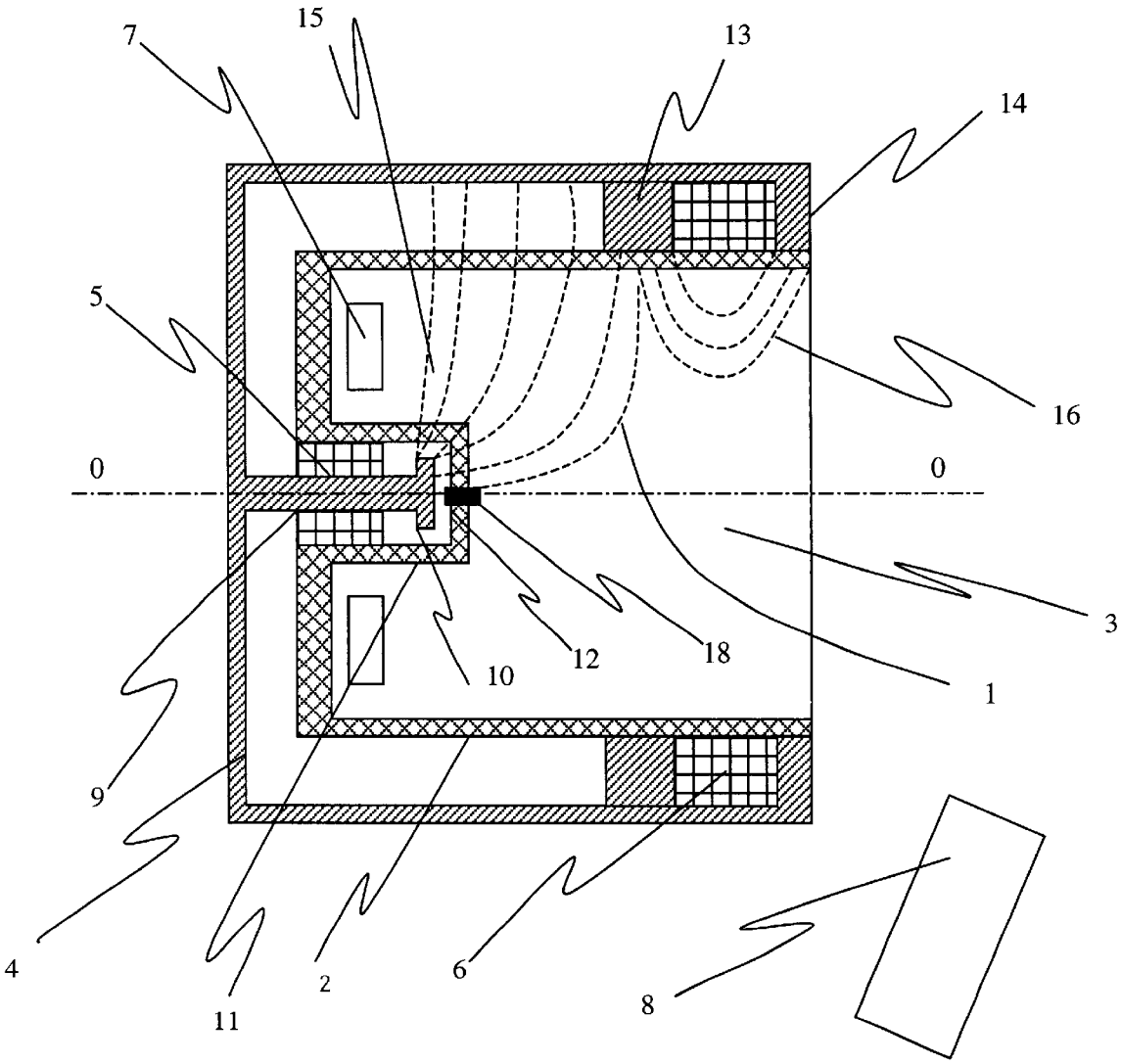
FIG. 6 is a schematic representation of a cylindrical geometry Hall thruster as in FIG. 4, with a cylindrical channel region 3 and a shorter annular channel region 15, with emissive segmented electrode ring 18 replacing the cathode neutralizer 8 of FIG. 4.

As a further preferred embodiment, the emissive electrode can be used on axis, as in FIG. 6, in order to replace or reduce the requirements on the cathode neutralizer 8.

The use of any of these embodiments and variations may be recommended depending on the anticipated parameters of the thruster regime, such as temperature, power, specific impulse, and propellant, as well as the anticipated mission requirements such as longevity, efficiency, and ease of satellite integration.

What we claim as our invention is:

1. A Hall thruster with substantially closed electron drift, with an electric potential field applied across a cylindrical ceramic channel, such that ions are accelerated and can flown axially across a magnetic field, wherein an electrons drift substantially in the azimuthal direction, comprising of:

an applied magnetic field that is substantially axial in the vicinity of the gas entrance and substantially radial in the vicinity of the thruster exit; and a distributor of propellant gas, such that said gas is ionized in said channel and then said ions are accelerated by said electric field; and an anode, near the point of entry of the propellant gas into the channel; and a cathode-neutralizer, located outside said channel, that both neutralizes said ion flow and establishes total accelerating voltage of said ions; and a magnetic circuit that produces said magnetic field.

2. An apparatus according to claim 1 such that an electrodes of conducting material are placed along said channel, separated electrically by spacers of dielectric material, such that said electrodes control the voltage drop across the channel so as to enhance the axial acceleration of the ions; and an electric circuit holding said electrode segments at specific potentials, so as to control the potential within the thruster channel.

3. An apparatus according to claim 1 such that said gas distributor is arranged off the axis of symmetry of the thruster so as to optimize the production of ions in the vicinity of the strongest axial accelerating electric fields.

4. An apparatus according to claim 1 such that an emissive electrode is placed in the region of axial magnetic field near the anode, such that said electrode is biased negative with respect to the anode.

5. An apparatus according to claim 4 such that said emissive electrode is sufficiently emissive to replace the cathode-neutralizer.

6. An apparatus according to claim 1 such that said thruster consumes less than 125 Watts.

7. An apparatus according to claim 6 such that said propellant gas is xenon.

8. A Hall thruster with substantially closed electron drift, with an electric potential field applied across a cylindrical ceramic channel, such that ions are accelerated and can flow axially across a magnetic field, wherein an electrons drift substantially in the azimuthal direction, comprising of:

an applied magnetic field that is substantially axial in the vicinity of the gas entrance and substantially radial in the vicinity of the thruster exit; and a magnetic circuit that produces said magnetic field; and a distributor of propellant gas, such that said gas is ionized in said channel and then said ions are accelerated by said electric field; and an anode, near the point of entry of the propellant gas into the channel; and a cathode-neutralizer, located outside said channel, that both neutralizes said ion flow and establishes total accelerating voltage of said ions; and a second magnetic field, applied at the channel wall so as to combine with the first magnetic field in such a manner as to produce a cusp in the total magnetic field, thereby to enhance further the magnitude of the radial component of the total magnetic field in the vicinity of the cusp, and thereby to decrease the axial component of the total magnetic field in the vicinity of the cusp.

a magnetic circuit that produces said second magnetic field.

9. An apparatus according to claim 8 such that an electrodes of conducting material are placed along said channel, separated electrically by spacers of dielectric material, such that said electrodes control the voltage drop across the channel so as to enhance the axial acceleration of the ions; and an electric circuit holding said electrode segments at specific potentials, so as to control the potential within the thruster channel.

10. An apparatus according to claim 8 such that said gas distributor is arranged off the axis of symmetry of the thruster so as to optimize the production of ions in the vicinity of the strongest axial accelerating electric fields.

11. An apparatus according to claim 8 such that an emissive electrode is placed in the region of axial magnetic field near the anode, such that said electrode is biased negative with respect to the anode.

12. An apparatus according to claim 11 such that said emissive electrode is sufficiently emissive to replace the cathode-neutralizer.

13. An apparatus according to claim 8 such that said thruster consumes less than 125 Watts.

14. A Hall thruster with substantially closed electron drift, with an electric potential field applied across a substantially cylindrical ceramic channel, such that ions are accelerated and can flow axially across a magnetic field, wherein an electrons drift substantially in the azimuthal direction, comprising of:

a distributor of propellant gas, such that said gas is ionized in said channel and then said ions are accelerated by said electric field; and such that said gas distributor is arranged off the axis of symmetry of the thruster so as to optimize the ionization of the gas off the axis of symmetry; and an anode, near the point of entry of the propellant gas into the channel; and a magnetic pole placed in front of said anode on a ceramic piece arranged so as to create a short annular region in the vicinity of the gas entrance into the thruster; and such that said applied magnetic field is substantially radial in the vicinity of the gas entrance in said short annular region; and such that said applied magnetic field is substantially axial near the thruster axis in the vicinity of the magnetic pole in the cylindrical region of the thruster; and substantially radial in the vicinity of the thruster exit; and a magnetic circuit that produces said magnetic field; and a cathode-neutralizer, located outside said channel, that both neutralizes said ion flow and establishes total accelerating voltage of said ions; and a second magnetic field, applied at the channel wall so as to combine with the first magnetic field in such a manner as to produce a cusp in the total magnetic field, thereby to enhance further the magnitude of the radial component of the total magnetic field in the vicinity of the cusp, and thereby to decrease the axial component of the total magnetic field in the vicinity of the cusp.

a magnetic circuit that produces said second magnetic field.

15. An apparatus according to claim 14 such that electrode segments of conducting material are placed along said channel, separated electrically by spacers of dielectric material, such that said electrodes control the voltage drop across the channel so as to enhance the axial acceleration of the ions; and an electric circuit holding said electrode segments at specific potentials, so as to control the potential within the thruster channel.

16. An apparatus according to claim 15 such that at least one anode-side electrode segment is placed on the outer wall near the annular part of the thruster; and such that said electrode is biased negative with respect to the anode.

17. An apparatus according to claim 14 such than an emissive electrode is placed in the region of axial magnetic field near the anode, such that said electrode is biased negative with respect to the anode.

18. An apparatus according to claim 17 such that said emissive electrode is sufficiently emissive to replace the cathode-neutralizer.

19. An apparatus according to claim 14 such that said thruster consumes less than 125 Watts.

20. An apparatus according to claim 19 such that said propellant gas is xenon.

* * * * *